US006035473A

United States Patent [19]

Felstead et al.

[11] Patent Number: 6,035,473

[45] **Date of Patent: *Mar. 14, 2000**

[54] DYE SCAVENGING ARTICLE

[75] Inventors: Philip S. Felstead; Stephen Ziskind, both of Delray Beach, Fla.

[73] Assignee: Dye Magnet Industries, Deerfield Beach, Fla.

[ * ] Notice: This patent is subject to a terminal disclaimer.

[21] Appl. No.: 09/267,806

[22] Filed: Mar. 12, 1999

Related U.S. Application Data

[63] Continuation-in-part of application No. 09/088,511, Jun. 1, 1998, Pat. No. 5,881,412.

[51] Int. Cl.[7] ..... D06F 39/00

[52] U.S. Cl. ..... 8/159; 68/13 R; 68/235 R

[58] Field of Search ..... 8/137, 150, 158, 8/159; 68/3 R, 13 R, 17 R, 17 A, 235 R

[56] References Cited

U.S. PATENT DOCUMENTS

| | | | |
|---|---|---|---|
| 3,048,993 | 8/1962 | Lucas et al. . | |
| 3,212,303 | 10/1965 | Haffner et al. . | |
| 3,575,021 | 4/1971 | Bochan . | |
| 3,670,530 | 6/1972 | Filipak . | |
| 3,673,110 | 6/1972 | Edwards . | |
| 3,694,364 | 9/1972 | Edwards . | |
| 3,816,321 | 6/1974 | Kleinschmidt . | |
| 3,869,069 | 3/1975 | Levey et al. . | |
| 4,026,131 | 5/1977 | Dugger et al. . | |
| 4,065,257 | 12/1977 | Coe et al. . | |
| 4,348,293 | 9/1982 | Clarke et al. . | |
| 4,380,453 | 4/1983 | Claiborne . | |
| 4,494,264 | 1/1985 | Wattiez et al. | 68/235 R |
| 4,555,354 | 11/1985 | Clarke et al. . | |
| 4,638,907 | 1/1987 | Bedenk et al. . | |
| 4,740,326 | 4/1988 | Hortel et al. . | |
| 4,756,037 | 7/1988 | McFadyen et al. . | |
| 4,835,804 | 6/1989 | Arnau-Munoz et al. . | |
| 4,882,917 | 11/1989 | Mizusawa et al. . | |
| 4,925,586 | 5/1990 | Baker et al. . | |
| 4,969,927 | 11/1990 | Schumann et al. . | |
| 5,698,476 | 12/1997 | Johnson et al. . | |
| 5,881,412 | 3/1999 | Ziskind | 68/235 R X |

*Primary Examiner*—Philip R. Coe

*Attorney, Agent, or Firm*—Lerner, David, Littenberg, Krumholz & Mentlik, LLP

[57] ABSTRACT

A dye scavenging article is provided for use in scavenging extraneous random dyes from the wash and rinse waters during a laundry process. The dye scavenging article is constructed to prevent its being trapped or commingled with the clothing items by including a buoyant or floatation member. A stiffening member may also be provided which maintains the dye scavenging article in an open state during the washing process. This construction allows the dye scavenging article to be exposed to the entire volume of wash and rinse waters during the laundry process to enhance effectiveness.

69 Claims, 11 Drawing Sheets

DYE SCAVENGING ARTICLE

This application is a continuation-in-part application of application Ser. No. 09/088,511, filed on Jun. 1, 1998, and now U.S. Pat. No. 5,881,412.

BACKGROUND OF THE INVENTION

The present invention relates in general to an article for removing random dyes from laundry washing applications, and more particularly, to a dye scavenging article for scavenging extraneous random dyes from laundry washing solutions during a complete laundering cycle, including both wash and rinse waters.

Undesirable dye staining of textile articles during laundering occurs when articles which have been dyed with dyes of poor wash fastness are washed together with articles which are either undyed or with articles dyed with dyes which have adequate fastness to washing. This problem, commonly known as "fading", results in the dye of one article bleeding onto an article of another color. If dye staining or bleeding occurs, the articles affected may be rendered unsuitable for further use unless rewashed with suitable oxidizing agents, such as chlorine bleaches, so as to remove the unwanted color. Unfortunately, many types of fabrics are not suitable for treatment with harsh oxidizing agents. This problem becomes more difficult since articles from which loosely held dyes are liable to bleed are not always identified nor is it possible to predict whether a dyed fabric will exhibit adequate wash fastness merely by visual examination.

Various attempts have been made to overcome the problem of dye staining or fading. For example, Coe, et al., U.S. Pat. No. 4,065,257 discloses the use of high molecular weight polyquaternary ammonium compounds as dye staining inhibitors. The dye staining inhibitors are employed as part of the soap or detergent composition suitable for washing textile articles. In Edwards, U.S. Pat. No. 3,694,364, there is disclosed the use of tertiary polymeric amines which function as anionic dye scavengers. The polymeric amines are chemically affixed on the surface of a substrate material such as cellulosic materials, for example, cotton in any of its forms, purified cotton cellulose, cellulose sponge and the like. To affix the polymeric amines, the cotton substrate is modified by phosphorylation and chemisorption of the polymeric amine. In Edwards' related U.S. Pat. No. 3,673,110, there is disclosed the use of both the tertiary polymeric amines and quaternary ammonium compounds as the dye scavenging material. The latter Edwards patent discloses other processes for chemically affixing the dye scavenger compounds to a cellulosic material substrate also for use in controlling undesirable random dyes in a liquid bath such as when laundering textile articles. For example, the hydroxylated surface of the cellulosic material is chemically modified to establish anionic functional groups. Each of the anionic functional groups are capable of chemically binding nitrogen compounds such as the aforementioned disclosed dye scavenger compounds.

In Kleinschmidt, U.S. Pat. No. 3,816,321 there is disclosed a dye scavenging article for scavenging anionic dyes released from dyed fabrics being laundered to prevent dye transfer during the laundry process. The dye scavenging article includes a support matrix such as a polyurethane material to which there is chemically bonded a dye scavenging compound. The dye scavenging compound includes polyquaternary ammonium compounds.

Claiborne, U.S. Pat. No. 4,380,453 discloses generally the use of N-trisubstituted ammonium-2-hydroxy-3 -halopropyl compounds and salts of epoxy propyl ammonium as dye scavenger compounds. The preferred dye scavenger compound is glycidyltrimethylammonium chloride which is applied to, adsorbed by or impregnated in the cellulosic material substrate. The resulting cellulosic material substrate is disclosed as being suitable for use in conventional washing machines for laundering clothes to eliminate random dyes from the wash and rinse waters, thereby eliminating undesirable discoloration of the clothes from fading of dyes from other clothes in the washing machine.

There is therefore known the use of a number of dye scavenger compounds, for example, quaternary ammonium compounds and tertiary polymeric amines, and polymers thereof, which are chemically affixed to a cellulosic material substrate for use in laundry machines for dye scavenging. The dye scavenger compounds disclosed in the aforementioned patents are incorporated herein by reference.

In Johnson, et al., U.S. Pat. No. 5,698,476 there is disclosed an article for removing extraneous, random free-flowing dyes from laundry washing applications. The laundry article includes two components, a dye absorber and a dye transfer inhibitor which are introduced into the wash water via a support matrix. The dye absorber is chemically attached to the support matrix to maintain a relational association during the laundry washing application. On the other hand, the dye transfer inhibitor is released from the support matrix into the wash water to be evenly distributed during the laundry washing application.

Materials disclosed in Johnson, et al. which are suitable as dye absorbers for the laundry article include quaternary N-substituted ammonium)-hydroxy-haloalkyl compounds such as 2-hydroxy-3-chloropropoyltrimethylammonium chloride; polyquaternary ammonium compounds; polyamphoterics; quaternized starches; proteins; chitin or its hydrolyzed form, chitosna; choline chloride; polyvinyl amine (PVAm); polyethylene imine (PEI); as well as combinations thereof. Dye transfer inhibitors include polyvinyl pyrrolidone, polyvinyl alcohol, polyvinyl imidazole, polyamine-N-oxides, cationic starches, magnesium aluminate, hydrotalcite, proteins, hydrolyzed proteins, polyethylene imines, polyvinyl oxazolidone, enzymes, oxidants, cationic surfactants, amphoteric surfactants, propylene oxide reaction products, polyamino acids, block co-polymers of alkylene oxides, polyamines, polyamides, methyl cellulose, carboxyalkyl, celluloses, guar gum, natural gums, alginic acid, polycarboxylic acids, cyclodextrins and mixtures thereof.

In order for a laundry article to be effective to as a dye scavenger, it is required that the article be free to circulate within the washing machine to be exposed to the entire volume of wash and rinse waters. In the event the laundry article becomes trapped or commingled within the clothing, the article would only be exposed to a small portion of the wash or rinse waters. As a result, extraneous random dye within the wash or rinse waters would be free to redeposit on clothing items being laundered. This dye transfer can cause undesirable discoloration resulting in unsatisfactory appearance of clothing being laundered, particularly, when the clothes are of a different color than the random dye.

There is known from Dugger, et al., U.S. Pat. No. 4,026,131, a laundry additive dispenser which is removably attached to a laundry machine agitator. In Dugger, et al., a pouch is formed for receiving a laundry additive to be released during the rinse cycle of an automatic washing machine. By way of example, the disclosed additives can be bleaches, soil release finishers, rinsing aids, freshening aids, anti-bacterial agents, anti-static agents, anti-pilling agents, fabric strengthening agents, stain removal agents, water softening materials, anti-yellowing agents, etc. The dispenser is removably attached to the agitator of a washing machine by a rectangular top section having an enlarged opening. In an alternative embodiment, a pair of flexible strips are attached to the dispenser so as to tie the dispenser to the agitator. Other attachment examples are disclosed, for example, the use of wire, string, foil, water, impermeable glue or adhesive for attaching the dispenser to the agitator. The dispenser is operative during the rinse cycle only as the centrifugal force created during the spin cycle causes the dispenser to open via a rupturable seal thereby discharging its contents after the wash period.

There is also known from Baker, et al., U.S. Pat. No. 4,925,586, a water insoluble, water permeable pouch containing a detergent composition to be dispensed only during the wash cycle. The detergent composition may include other laundry aids such as bleach activators, flow aids, suds boosters, dyes, germacides, enzymes, chelating agents, etc. The pouch is releasably attached over the agitator by means of elongated strips which form a circular loop so as to be loosely fitted over the agitator. The detergent composition and/or other laundry aids dissolve out of the water permeable pouch by the force of the agitator and the wash water.

The laundry additive dispenser of Dugger, et al. and the pouch of Baker, et al. are not suitable for use as a dye scavenging article. In particular, as the dye scavenging compounds are water soluble, they must be chemically bonded to a support matrix to prevent their dissolving in the wash and rinse waters. On the other hand, the laundry additives and detergent compositions of Dugger, et al. and Baker, et al. rely upon their water solubility for dispensing during the rinse and wash cycles. Still further, the laundry additive dispenser of Dugger, et al. and detergent pouch of Baker, et al. are operative only for dispensing the laundry aids during a selected cycle during the laundry washing process, i.e., either the rinse cycle or the wash cycle. Thus, neither Baker, et al. nor Dugger, et al. provide for the treatment of both the wash and rinse waters for all cycles of the washing process.

In addition to the foregoing prior art, Haffner, et al., U.S. Pat. No. 3,212,303 discloses a hook for holding soiled articles in a water closet for cleaning. Clarke, et al., U.S. Pat. No. 4,348,293 discloses a water-permeable, water-insoluble bag containing a laundry aid such as a detergent powder for use in a washing machine. Hortel, et al., U.S. Pat. No. 4,740,326 discloses a single sheet, pouch or bag supporting a soil release polymer which contains a detergent and/or breaching composition. Mizusawa, et al., U.S. Pat. No. 4,882,917 discloses a wash additive article such as a fabric softener which is supported on top of the washing machine agitator for ejection into the rinse water during the high speed spinning of the agitator. Filapak, U.S. Pat. No. 3,670,530 and Bochan, U.S. Pat. No. 3,575,021, each disclose dispensers attached to the laundry machine agitator which are operative by the centrifugal force created during the spin cycle. Lucas, et al., U.S. Pat. No. 3,048,993 discloses a porous cotton bag which is initially attached to the laundry machine agitator and discharged into the wash water by the centrifugal force created during the spin cycle.

Notwithstanding the foregoing, there exists the need to develop a dye scavenging article for use in washing machines and the like which will prevent its being trapped and/or commingled with the clothing being washed during the entire laundry cycle, including both the wash and rinse cycles. In the absence of the laundry article being free to circulate within the washing machine so as to be exposed to the entire volume of wash and rinse waters, the article will be ineffective as a dye scavenger.

SUMMARY OF THE INVENTION

The present invention provides a dye scavenging article which is effective for scavenging random undesirable dye from the wash and rinse waters during the entire laundry washing cycle.

The present invention also provides a dye scavenging article which is maintained within an automatic washing machine to prevent the article from becoming trapped and/or commingled with the clothing during the entire laundry washing cycle.

The present invention also provides a dye scavenging article which is disposable after its intended use.

The present invention also provides a dye scavenging article to which there is chemically bonded a polyquaternary ammonium compound.

The present invention also provides a dye scavenging article which has buoyant properties.

In accordance with one embodiment of the present invention there is disclosed an article for use in a washing machine operative for washing textile items in a liquid. The article includes a substrate material supporting a dye scavenging compound, and means for removably securing the substrate material within the washing machine during the operation thereof, whereby said substrate material is prevented from commingling with the items within the washing machine while exposing the dye scavenging compound to the liquid during the operation of the washing machine.

In accordance with another embodiment of the present invention there is disclosed an article for use in a washing machine operative for washing textile items in a liquid. The article includes a substrate material supporting a dye scavenging compound removably securable within the washing machine during the operation thereof, whereby the substrate material is prevented from commingling with the items within the washing machine while exposing the dye scavenging compound to the liquid during the operation of the washing machine.

In accordance with another embodiment of the present invention there is disclosed an article for use in a washing machine operative for washing textile items in a liquid. The article includes a substrate material supporting a dye scavenging compound, the substrate material constructed for preventing the substrate material from commingling with the items within the washing machine while exposing the dye scavenging compound to the liquid during the operation of the washing machine.

In accordance with another embodiment of the present invention there is disclosed a method for controlling random dye in a liquid containing textile items during the operation of a washing machine. The method includes the steps of placing in the liquid a dye scavenging article comprising a substrate material supporting a dye scavenging compound, maintaining the dye scavenging article in contact with the liquid during operation of the washing machine whereby the random dye within the liquid becomes associated with the dye scavenging compound, and preventing the dye scavenging article from commingling with the items within the washing machine during the operation thereof.

In accordance with another embodiment of the present invention there is disclosed a method for scavenging random dye in a liquid containing textile items of different colors which are the source of at least one random dye during the operation of a washing machine. The method includes the steps of releasably attaching a dye scavenging article to the washing machine, the dye scavenging article comprising a substrate material supporting a dye scavenging compound, whereby the dye scavenging article is prevented from commingling with the items within the washing machine during the operation thereof during at least a wash and rinse cycle of the washing machine, maintaining the dye scavenging article in continuous contact with the liquid within the washing machine during the operation thereof, whereby the at least one random dye within the liquid becomes associated with the dye scavenging compound to prevent the at least one random dye from becoming associated with the items during the operation of the washing machine.

In accordance with another embodiment of the present invention there is disclosed an article for use in a washing machine operative for washing textile items in a liquid, the article comprising a substrate material supporting a dye scavenging compound, and means for increasing the buoyancy of the article whereby the substrate material is substantially prevented from becoming trapped within the items within the washing machine during the operation thereof while exposing the dye scavenging compound to the liquid.

In accordance with another embodiment of the present invention there is disclosed an article for use in a washing machine operative for washing textile items in a liquid, the article comprising a substrate material supporting a dye scavenging compound, and a floatation member attached to the substrate material whereby the substrate material is substantially prevented from becoming trapped within the items within the washing machine during the operation thereof while exposing the dye scavenging compound to the liquid.

In accordance with another embodiment of the present invention there is disclosed an article for use in a washing machine operative for washing textile items in a liquid, said article comprising a substrate material supporting a dye scavenging compound, and means for maintaining said substrate material in an open state within said washing machine during the operation thereof while exposing said dye scavenging compound to said liquid, whereby said substrate material is substantially prevented from forming into a closed state within said washing machine during the operation thereof.

In accordance with another embodiment of the present invention there is disclosed an article for use in a washing machine operative for washing textile items in a liquid, the article comprising a substrate material supporting a dye scavenging compound, and a stiffening member attached to the substrate material, the stiffening member maintaining the substrate material in an open state within the washing machine during the operation thereof while exposing the dye scavenging compound to the liquid, whereby the substrate material is substantially prevented from forming into a closed state within the washing machine during the operation thereof.

In accordance with another embodiment of the present invention there is disclosed a method for controlling random dye in a liquid containing textile items during the operation of a washing machine, the method comprising the steps of placing in the liquid a dye scavenging article comprising a substrate material supporting a dye scavenging compound, attaching a buoyant member to the substrate material, the buoyant member preventing the substrate material from becoming substantially trapped within the items within the washing machine during the operation thereof, and maintaining the substrate material in substantial contact with the liquid during operation of the washing machine whereby the random dye within the liquid becomes associated with the dye scavenging compound.

In accordance with another embodiment of the present invention there is described a method for controlling random dye in a liquid containing textile items during the operation of a washing machine, the method comprising the steps of placing in the liquid a dye scavenging article comprising a substrate material supporting a dye scavenging compound, and maintaining the substrate material in a substantially open state in substantial contact with the liquid during operation of the washing machine whereby the random dye within the liquid becomes associated with the dye scavenging compound.

BRIEF DESCRIPTION OF THE DRAWINGS

The above description, as well as further objects, features and advantages of the present invention will be more fully understood with reference to the following detailed description of a dye scavenging article, when taken in conjunction with the accompanying drawings, wherein.

DETAILED DESCRIPTION OF THE PREFERRED EMBODIMENTS

Figure 1:
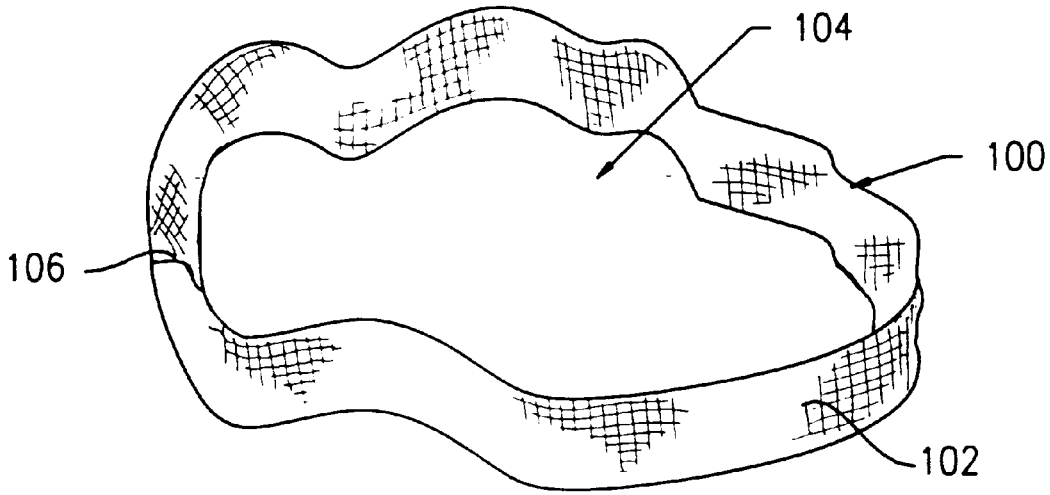
FIG. 1 is a perspective view of a dye scavenging article constructed in accordance with one embodiment of the present invention.

In accordance with the present invention, there is disclosed a dye scavenging article for use in conventional washing machines for laundering clothes to eliminate extraneous random dyes from both the wash and rinse waters thereby preventing discoloration of the clothes by fading of the dyes in the washing machine. The dye scavenging article generally includes two components, a substrate and a dye scavenger compound which is chemically bonded to the substrate.

Dye scavenging compounds found suitable for use in accordance with the preferred embodiment of the present invention comprise the general class of compounds known as polyquaternary ammonium compounds. In particular, the preferred compound comprises a quaternary salt of dimethylamine x epichlorohydrin having the general formula $(C_3H_5ClO.C_2H_7N)n$, and more specifically:

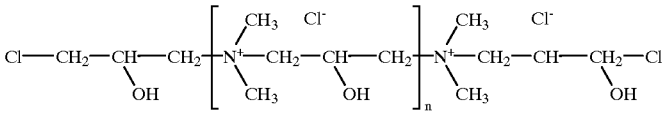

wherein n shows a polymerization degree and is a whole number in the range from about 10 to about 100. A polyquaternary ammonium compound of the above general formula is available from Clariant Corporation of Charlotte, N.C. under the trademark VRN. However, it is contemplated that the dye scavenging compounds disclosed in the aforementioned patents can also be chemically bonded to a substrate such as cellulosic materials for use in accordance with the present invention.

The substrate material for use in the present invention must be substantially water insoluble. In accordance with the preferred embodiment of the present invention, the substrate material will generally have anionic functional groups on its surface which are free to chemically react with the aforementioned dye scavenger compounds. Since these materials do not generally exist, it is necessary to chemically modify the surface of a suitable material to establish the requisite anionic groups. One type of functional group found on the surface of cellulosic materials is the hydroxyl group which can be converted to anionic functional groups. Exemplary cellulosic materials include rayon, cotton, in any of its forms, for example, purified cotton cellulose, cellulose sponge and the like. The substrate may further be provided in any physical form such as woven, non-woven, braided, knitted fabric or any other desirable configuration.

It should therefore be appreciated that the substrate of the present invention may comprise any desirable material, such as cellulosic material, polyurethane material and the like, to which a polyquaternary ammonium compound or other suitable dye scavenger compound can be attached, as well as taking any desirable form. Cellulosic material is preferred in view of its hydroxylated surface, as well as possessing sufficient web strength and sufficient abrasion strength to maintain its integrity as a dye scavenging article when used in a washing machine.

In accordance with one embodiment of the present invention, a polyquaternary ammonium compound, by way of example one having the general formula $(C_3H_5ClO.C_2H_7N)n$ is chemically attached to a cellulosic material substrate, and preferably a pure cotton towel having a large surface area. A method of chemically attaching the polyquaternary ammonium compound to the cellulosic material substrate is, for example, described in U.S. patent application Ser. No. 09/026,714 entitled "Method of Bonding a Polyquaternary Ammonium Compound to Cellulosic Material", filed on Feb. 20, 1998 in the name of James O. Threlkeld, which application is assigned to the assignee of the present application. The disclosure of the aforementioned U.S. Patent Application is incorporated herein by reference.

The disclosed method covalently bonds to a cellulosic material substrate a polyquaternary ammonium compound of the aforesaid general formula which exhibits dye scavenging properties for use in controlling extraneous undesirable random dye in a liquid bath containing a source of undesirable random dye and textile articles. By way of example, an aqueous solution containing the aforementioned quaternary ammonium compound is adjusted to a pH in the range of about 10 to about 12.5 using sodium hydroxide. A cellulosic material substrate is padded with the pH adjusted solution and subjected to heating at an elevated temperature in the range of about 100° C. to about 120° C. The cellulosic material substrate is held at temperature for about fifteen minutes to dry the substrate and to chemically bond the compound to the substrate. Any residual sodium hydroxide on the substrate is neutralized by placing the substrate in an aqueous bath containing an acid in sufficient amount to maintain the pH of the bath in the range of about 5–6.

Other suitable compounds for use as the dye scavenger and methods for attaching same to a substrate material are disclosed in the aforementioned U.S. patents, the disclosures of which are incorporated herein by reference, for example, chemically bonding polyquaternary ammonium compounds to polyurethane material as disclosed in U.S. Pat. No. 3,816,321.

Figure 2:
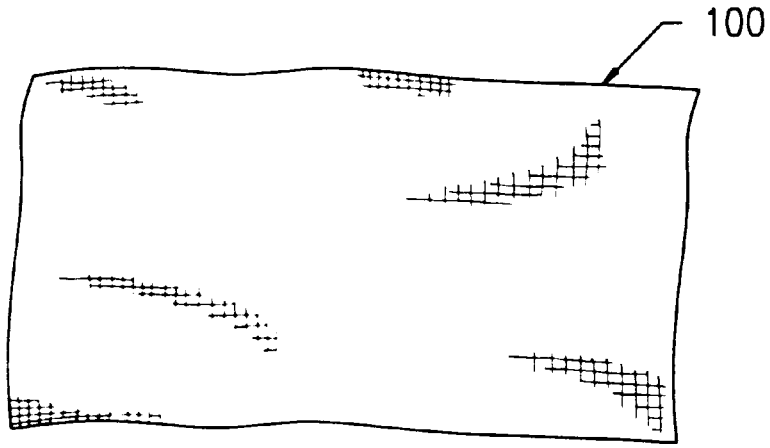
FIG. 2 is a front elevational view of a dye scavenging article constructed in accordance with another embodiment of the present invention.

Turning now to the drawings, wherein like reference numerals represent like elements, there is shown in FIG. 1 a perspective view of a dye scavenging article constructed in accordance with one embodiment of the present invention and generally designated by reference numeral 100. The article 100 of FIG. 1 is constructed in the shape of a continuous ring 102 defining an enlarged opening 104. As shown in FIG. 2, the dye scavenging article 100 can be constructed from a rectangular piece of cellulosic material to which a polyquaternary ammonium compound or other suitable dye scavenging material has been chemically attached thereto, for example, through absorption, adsorption, chemical reaction or other suitable means for adhering the water soluble compound thereto. The dye scavenging article 100 can be rolled or folded into an elongated shape such that its ends can be attached together as shown in FIG. 1. In addition, the dye scavenging article 100 can also be constructed as an elongated strip so as to avoid the necessity of folding or rolling. The elongated sheet or strip of cellulosic material may be secured at its free ends, such as by stitching generally designated by reference numeral 106. The ring 102 can also be formed, for example, where a sheet of cellulosic material is woven or knitted so as to form the continuous ring. In addition, the free ends of the ring 102 may be attached together by other suitable means, such as stapling, tying, adhesive bonding and the like. In forming the ring 102, it is also possible to provide elastic strips running throughout the dye scavenging article which will allow the opening 104 to expand and contract to aid in affixing the dye scavenging article 100 to, for example, the agitator of a washing machine.

Figure 3:
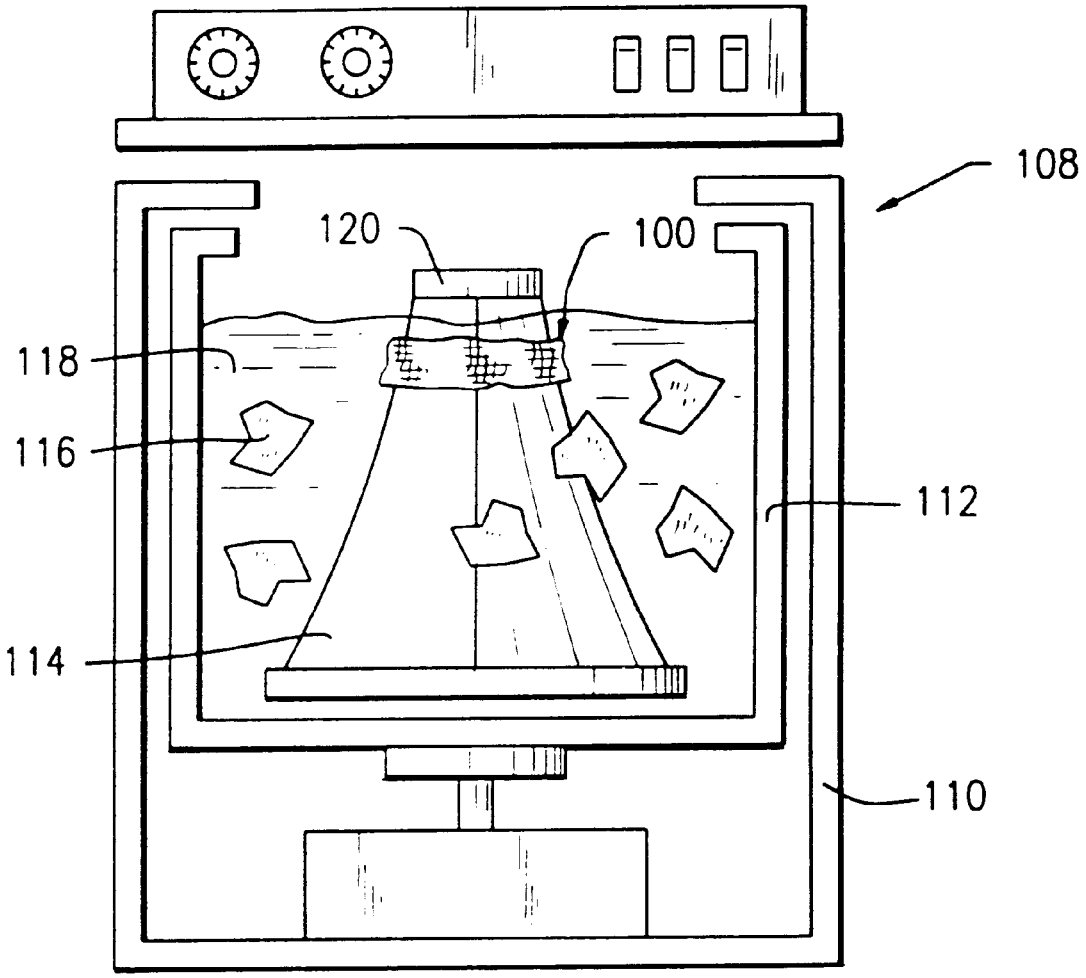
FIG. 3 is a front elevational view, in partial cross-section, showing an automatic laundry machine during use thereof with a dye scavenging article constructed in accordance with one embodiment of the present invention.

Referring now to FIG. 3, a conventional automatic washing machine 108 generally includes an outer housing 110 which rotationally supports an internal laundry tub 112. An agitator 114 is rotatably supported within the laundry tub 112 to effect agitation and commingling of the clothing items 116 within the wash and rinse waters 118 during the laundering process. It is to be understood that the washing machine 108, as thus far described, is merely exemplary of a washing machine for washing clothing items 116 during a laundry washing process having suitability for use with a dye scavenging article 100 constructed in accordance with the present invention. In this regard, as will become apparent from a further description of the construction and application of the dye scavenging articles 100 of the present invention, a washing machine 108 of the front loading type which eliminates an agitator 114 is also suitable for use with dye scavenging articles constructed in accordance with the present invention.

In use, a dye scavenging article 100, such as disclosed in FIG. 1 in the shape of a ring 102, is positioned about the agitator 114 by receiving the upper end of post 120 within the opening 104. The size of the opening 104 may be dimensioned so as to loosely receive the post 120. Alternatively, the size of the opening 104 may be constructed to receive the post 120 in friction fit by requiring that the dye scavenging article 100 be slightly stretched. Still alternatively, should the dye scavenging article 100 includes elastic fibers, the ring 102 will compress about the post 120 to provide a snug fit. In either cases, the dye scavenging article 100 by virtue of its inner facing portions forming the boundaries of the opening 104 holds the article in position within a central region of the laundry tub 112 by post 120 of the agitator 114. This prevents the dye scavenging article 100 from becoming trapped and/or commingled with the clothing items 116 during the entire washing cycle which includes both the wash and rinse cycles. Due to the turbulence created within the wash and rinse waters by the agitator 114, the entire volume of the wash and rinse waters are exposed to the dye scavenging article 100 so as to scavenge extraneous random dye which may be present as a result of the clothing items 116.

The dye scavenging article 100 is constructed in accordance with the present invention so as to preclude its being trapped and/or commingled with the clothing items 116 within the wash and rinse waters 118 during the laundering operation. As described with respect to FIG. 1, the dye scavenging article 100 is constructed in the shape of a ring having an opening 104 so as to be retained about the agitator 114 of the washing machine 108. However, it is to be understood that the dye scavenging article 100 can be constructed in other shapes and provided with other features which will preclude the dye scavenging article from becoming trapped and/or commingled with the clothing items 116.

Figure 4:
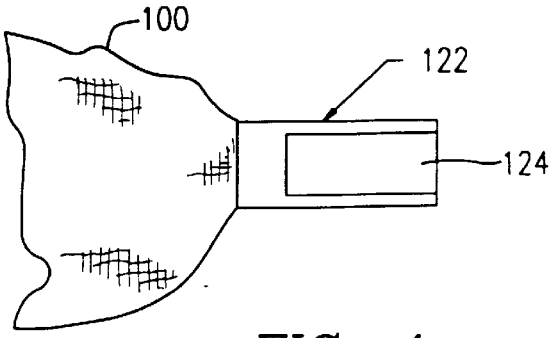
FIG. 4 is a partial view of a dye scavenging article having an assembly constructed in accordance with one embodiment of the present invention for removably attaching the dye scavenging article to a portion of a laundry machine.

Referring to FIG. 4, there is shown a portion of a dye scavenging article 100 which, as shown in FIG. 2, can be in the form of a rectangular or other shaped body of cellulosic material, e.g., oval, round, triangular, irregular and the like. Attached to at least one portion of the dye scavenging article 100 is a clip 122. The clip 122 may be constructed in a variety of configurations, all of which are adapted for releasably securing the dye scavenging article 100 to a portion of the washing machine 108. By way of illustration, the clip 122 will be releasably attachable to a portion of the agitator 114, a portion of the laundry tub 112 or a portion of the housing 110. In this regard, the dye scavenging article 100 will hang or extend into the laundry tub 112 so as to be in fluid contact with the wash and rinse waters 118 during the entire laundry operation. By virtue of the clip 122, the dye scavenging article 100 will be precluded from becoming trapped and/or commingled with the clothing items 116.

The clip 122 will typically include some form of clasp 124 which will resiliently engage a portion of the agitator 114, laundry tub 112 or housing 110. The clasp 124 will provide sufficient strength to prevent the dye scavenging article 100 from being pulled into the laundry tub 112 with the clothing items 116, such as by operation of the agitator 114, during the laundry process. As the clip 122 may be in contact with the wash and rinse waters, it is preferred that the clip be made of material such as plastic to prevent corrosion.

Figure 5:
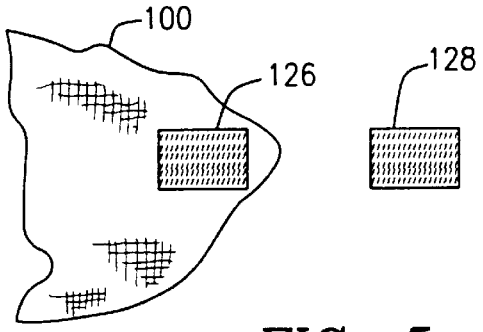
FIG. 5 is a partial view of a dye scavenging article having an assembly constructed in accordance with another embodiment of the present invention for removably attaching the dye scavenging article to a portion of a laundry machine.

Referring to FIG. 5, the dye scavenging article 100 incorporates Velcro® material including one component 126 attached to the cellulosic material and a second mating component 128. The mating component 128 may be attached to a portion of the interior of the washing machine 108 such as within the laundry tub 112 or to the agitator 114 using suitable means, such as an adhesive. The Velcro® material allows the dye scavenging article 100 to be removable yet secured when the components 126, 128 are mated.

Figure 6:
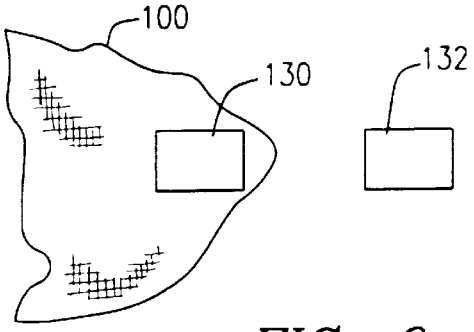
FIG. 6 is a partial view of a dye scavenging article having an assembly constructed in accordance with still another embodiment of the present invention for removably attaching the dye scavenging article to a portion of a laundry machine.

As shown in FIG. 6, a magnetic arrangement may be used for removably attaching the dye scavenging article 100 to the interior of the washing machine 108. For example, a magnet 130 may be attached to dye scavenging article 100, while a magnetizable metal 130 may be secured to the interior of the washing machine 108. The magnetizable material 130 can be constructed of a polymer base so as to prevent corrosion within the wash and rinse waters. Similarly, the magnetizable component 132 may be formed from a polymer base. In addition, either of the components 130, 132 may be attached to the dye scavenging article 100, the other component to the laundry tub 112, agitator 114 or housing 110.

Figure 7:
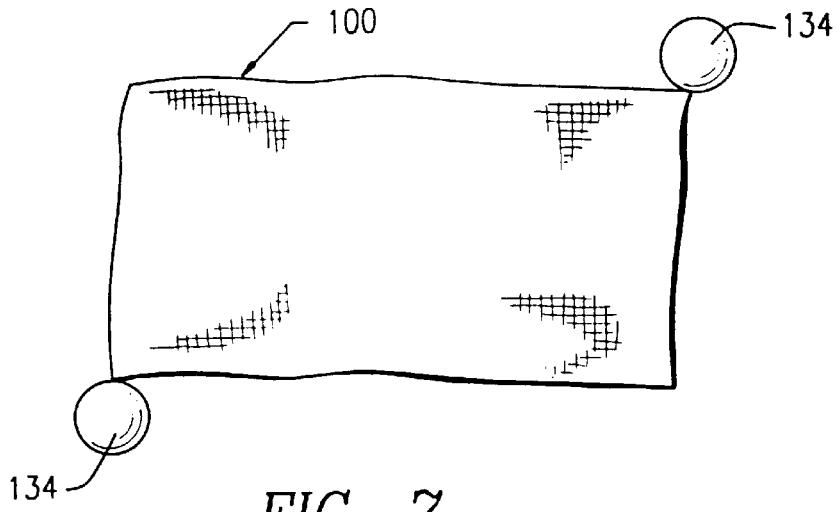
FIG. 7 is a front elevational view of a dye scavenging article having an assembly constructed in accordance with still another embodiment of the present invention.

Referring to FIG. 7, the dye scavenging article 100 includes, at least one, and preferably two or more flotation balls 134. The flotation balls 134 have a tendency to keep the dye scavenging article 100 within the upper layers of the rinse and wash waters due to their buoyancy to prevent the article from being pulled down by operation of the agitator 114 to become trapped or commingled with the clothing items 116 being washed. The flotation balls 134 may be of any construction, for example, hollow plastic balls, Styrofoam balls, or any other suitable body which will be buoyant so as to float within the wash and rinse waters.

Figure 8:
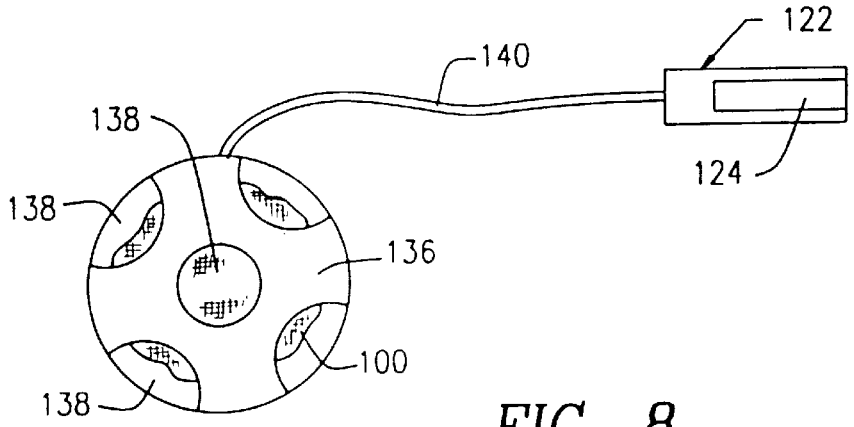
FIG. 8 is a front elevational view of a dye scavenging article having an assembly constructed in accordance with still another embodiment of the present invention for removably attaching the dye scavenging article to a portion of a laundry machine.

Turning to FIG. 8, a dye scavenging article 100 is positioned within a hollow ball 136 having a plurality of enlarged openings 138. The openings 138 allow the wash and rinse waters to freely flow through the ball 136 so as to be exposed to the dye scavenging article 100. The ball 136 may desirably be attached to the washing machine 106 using a suitable clasp 122 which is tethered to the ball by means of a rope 140.

Figure 9:
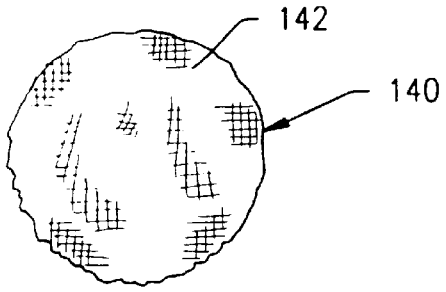
FIG. 9 is a front elevational view of a dye scavenging article having an assembly constructed in accordance with still another embodiment of the present invention.

Turning to FIG. 9, a dye scavenging article 140 includes a cellulosic material 142 to which there is chemically bonded a polyquaternary ammonium compound. The cellulosic material 142 is covered over a flotation ball 134 (not shown). The flotation ball will be of sufficient size to prevent its entrapment or commingling with the clothing items being laundered. In addition, the dye scavenging article 140 can be tethered as previously described with respect to FIG. 8.

Figure 10:
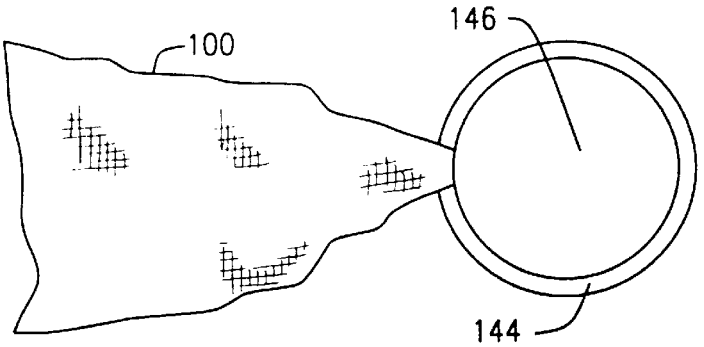
FIG. 10 is a partial view of a dye scavenging article having an assembly constructed in accordance with still another embodiment of the present invention for removably attaching the dye scavenging article to a portion of a laundry machine.

Turning to FIG. 10, a dye scavenging article is attached to a ring 144, preferably of plastic material, having an enlarged opening 146. The ring may be placed over the post 120 of a washing machine agitator 114 in a similar manner to ring 102 as shown in FIG. 3.

The dye scavenging article 100 of the present invention may be constructed in a variety of shapes and forms for use in scavenging extraneous dye during a laundry process for dyed textile articles and the like. In this regard, the dye scavenging article includes a support matrix, for example, a cellulosic material, polyurethane, and the like to which there is affixed a dye scavenging compound. Preferably, the dye scavenging article comprises a cellulosic substrate to which there is chemically attached a polyquaternary ammonium compound.

In order to be the most effective, it is a requirement that the dye scavenging article 100 be freely exposed to the entire volume of wash and rinse waters during the entire laundry process. To this end, the construction of the dye scavenging article 100 should preclude its entrapment or commingle-ment with the clothing items being laundered. In accordance with the various described embodiments, the dye scavenging article can be constructed in the shape of a ring which can be placed over an agitator of the washing machine to prevent its entrapment or commingle-ment with the clothing items being washed. In addition, various clips and other devices may be used, such as Velcro® material, magnetizable materials, flotation devices, and the like to keep the dye scavenging article 100 free from the clothing items. These latter embodiments are particularly suitable to washing machines which do not include an agitator, such as front loading machines. Still further, the dye scavenging article 100 may be provided with suitable adhesives, ropes, wires, elongated strips extending from the article and the like for attaching same to a portion of the washing machine, for example, the agitator 114.

Figure 11:
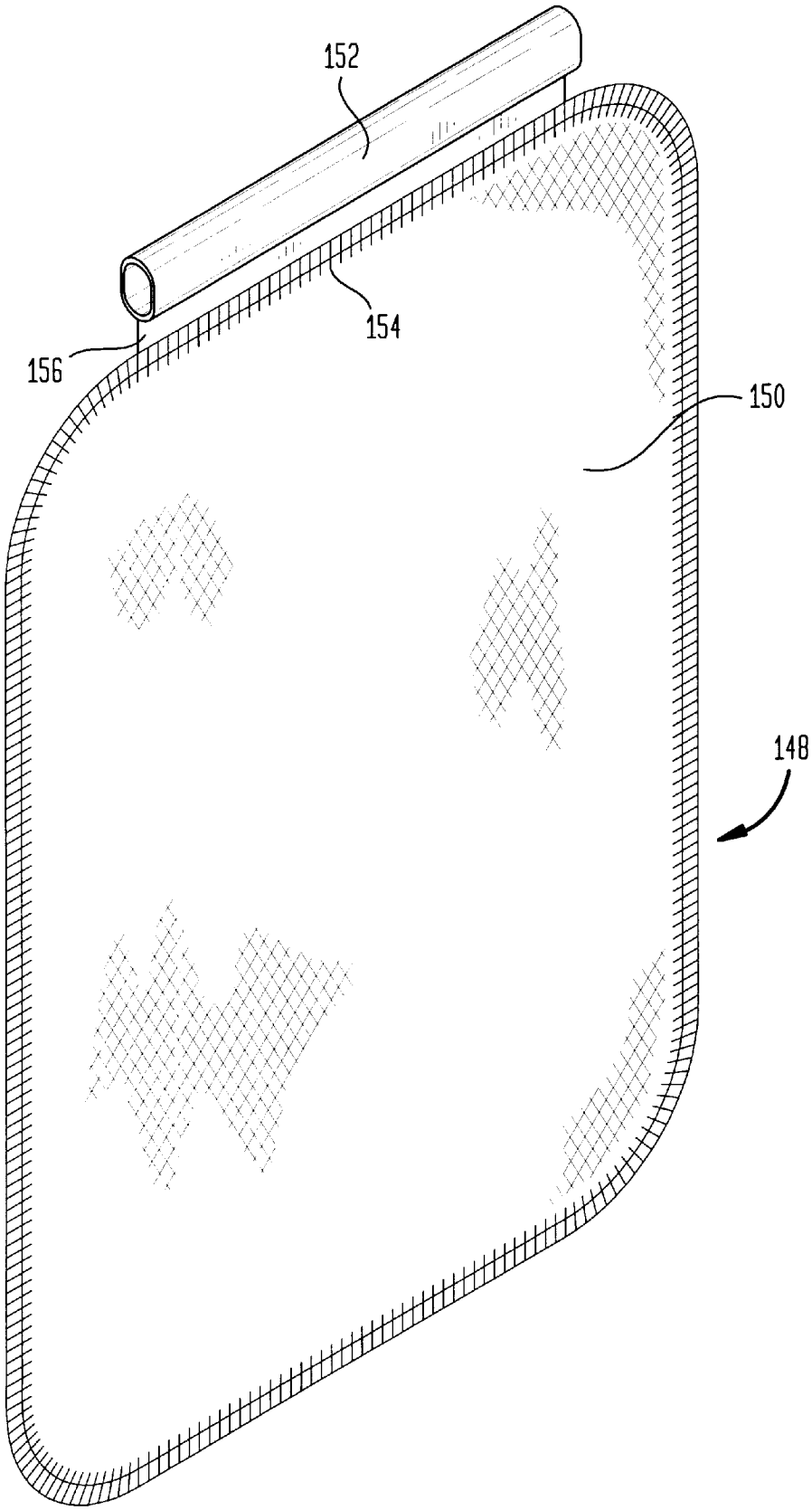
FIG. 11 is a perspective view of a dye scavenging article constructed in accordance with still another embodiment of the present invention.

As disclosed in FIG. 7, the dye scavenging article 100 includes at least one, and preferably two or more floatation balls 134. The floatation balls 134 have a tendency to keep the dye scavenging article 100 within the upper layers of the rinse and wash waters due to their buoyancy to prevent the article from being pulled down by operation of the agitator 114 to become trapped or commingled within the clothing items 116 being washed. Referring now to FIG. 11, there is shown a dye scavenging article 148 which includes a rectangular piece of cellulosic substrate material 150 to which a polyquarternary ammonium compound or other suitable dye scavenging material has been chemically attached, for example, through absorption, adsorption, chemical reaction or other suitable means for adhering the water soluble compound thereto. Although the substrate material 150 has been illustrated as rectangular, it is to be understood that any other shape such as oval, triangular, polygonal and the like can be used in accordance with the present invention.

Figure 16:
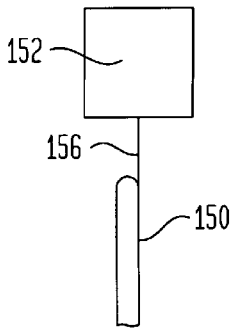
Figure 17:
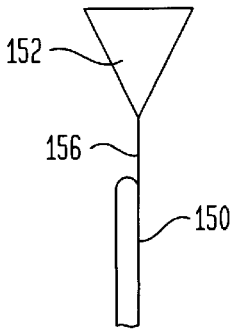
Figure 18:
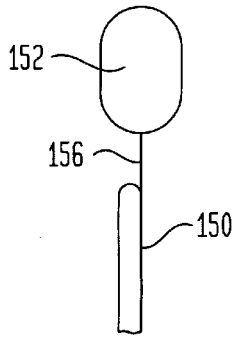

A buoyant or floatation member 152 is attached to the substrate material 150 along one edge 154 thereof. The floatation member 152 may be constructed in a variety of shapes from a variety of materials. In this regard, one function of the floatation member 152 is to provide buoyancy to the dye scavenging article 148. In this regard, the buoyancy of the floatation member 152 is greater than the buoyancy of the substrate material 150, and in particular, having a buoyancy which will cause the floatation member to float in the wash and rinse waters during the laundry process. It can therefore be appreciated that the floatation member 152 can be constructed from materials having a density less than one, for example, rigid Styrofoam, closed cell foam and other polymer materials, and preferably foamed rigid materials, natural materials such as cork and the like. In addition, the floatation member 152 can be constructed from a closed hollow rigid tube from plastic or other materials which will not rust or be affected by the wash and rinse liquids, as well as laundry additives such as bleach and the like. The floatation member 152 may be constructed as a single unitary member or a plurality of members having any desirable cross-sectional shape and length. For example, as shown in FIGS. 16–18, the floatation member 152 may have a polygonal shape, a rectangular shape, a triangular shape, an oval or round shape and the like.

The floatation member 152 may be attached to the substrate material 150 by any suitable means. For example, as shown in FIG. 11, the floatation member 152 is attached to the substrate material 150 by means of a web 156. The web 156 may be formed of any suitable material, such as the same material as or portion of the substrate material 150, a polymer material such as nylon or polyester mesh material and the like. The web 156 can be adhered, for example, along edge 154 of the substrate material 150 and to the floatation member 152 such as by stitching, gluing, plastic staples or any other suitable means.

Figure 12:
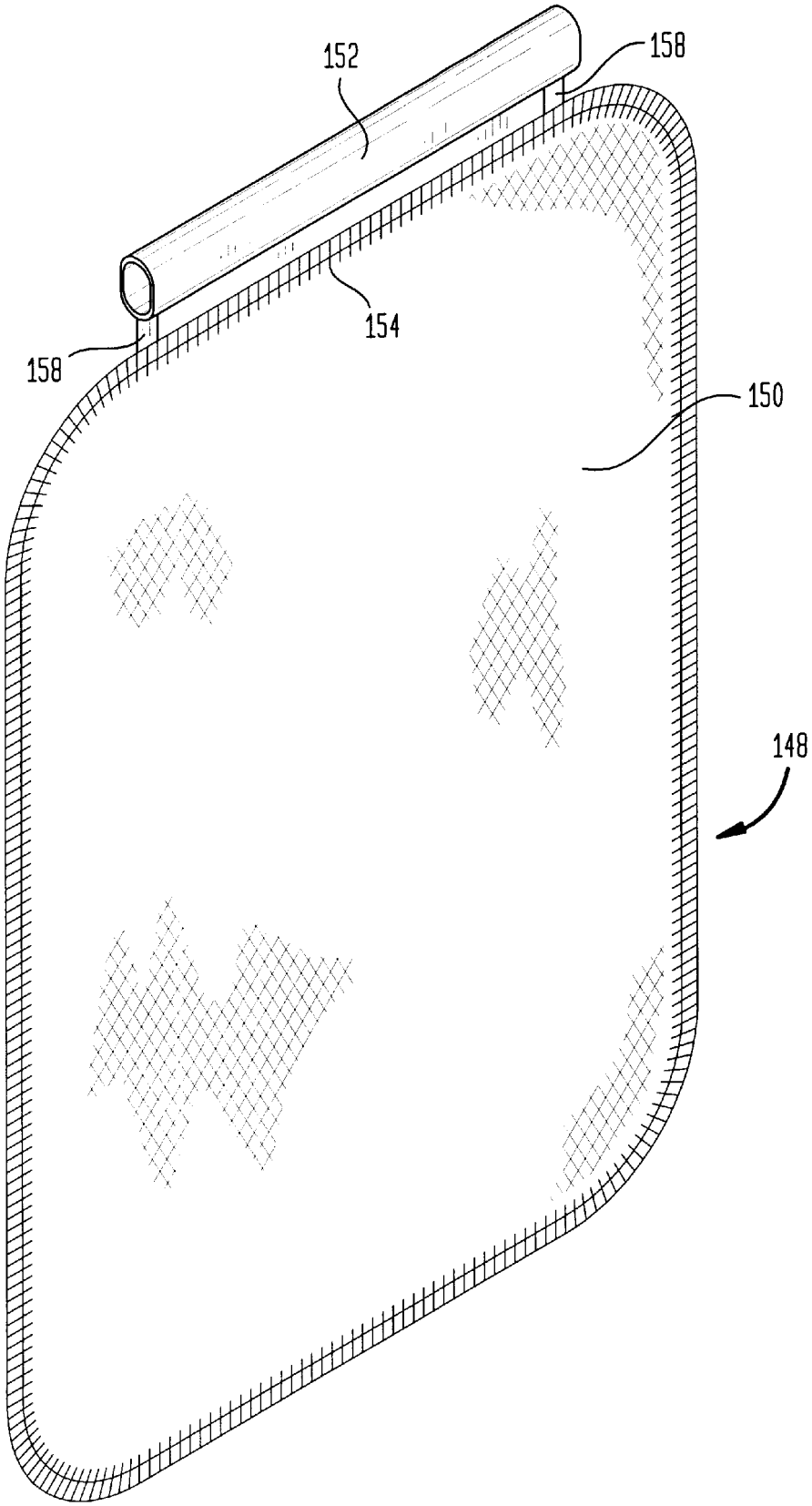
FIG. 12 is a perspective view of a dye scavenging article constructed in accordance with still another embodiment of the present invention.

In another embodiment as shown in FIG. 12, the floatation member 152 is attached to the substrate material 150 by means of a pair of straps 158 which may be attached at either ends of the floatation member. The straps 158 may be constructed from similar materials as described with respect to the web 156.

Figure 13:
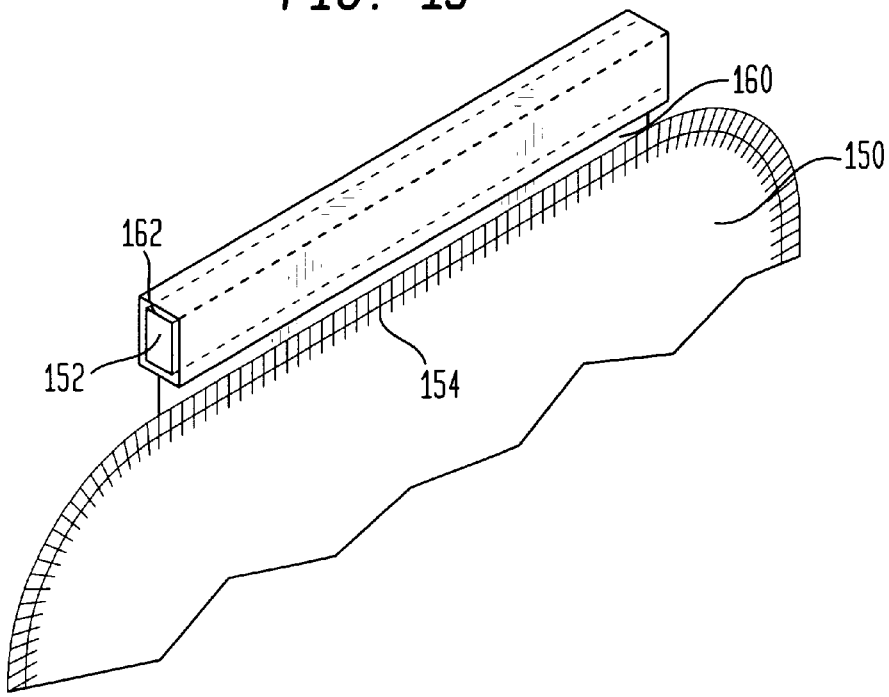
FIG. 13 is a partial perspective view of a dye scavenging article constructed in accordance with still another embodiment of the present invention.

Referring to FIG. 13, a web 160 may have its free ends attached to edge 154 of the substrate material 150 to define an elongated open pouch 162. The pouch 162 is sized to receive the floatation member 152 which may be removed therefrom so as to be reusable once the substrate material 150 has expired. In the alternative, the floatation member 152 may be adhered within the pouch 162 by any suitable means, for example, by stitching, gluing and the like. As shown, the pouch 162 by virtue of its generally flexible construction will accommodate any shape floatation member 152. Although the floatation member 152 has been thus far described as being attached to one edge 154 of the substrate material 150, it is to be understood that a plurality of floatation members along adjacent or opposite edges of the substrate material may also be provided. In addition, the floatation member 152 may be adhered to any other portion of the substrate material 150 as will be apparent from the operation of the floatation member as now to be described.

Figure 14:
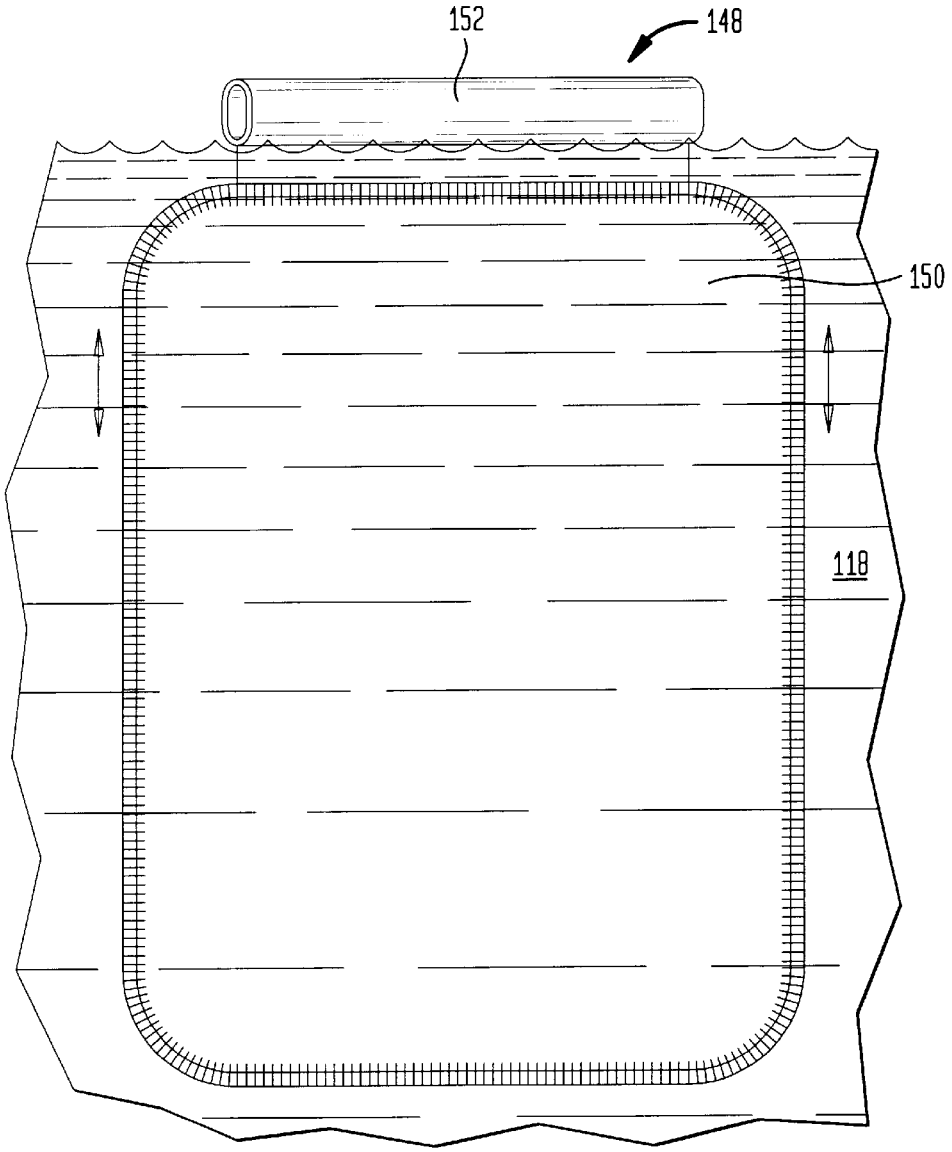
FIG. 14 is a front elevational view showing a dye scavenging article constructed in accordance with one embodiment of the present invention in a portion of a laundry machine.
Figure 15:
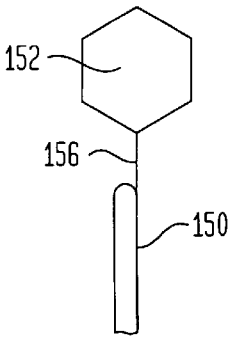
FIGS. 15, 16, 17 and 18 are partial end views of a dye scavenging article constructed in accordance with still other embodiments of the present invention.

Turning to FIG. 14, the dye scavenging article 158 is placed within the interior of a washing machine 108 such as shown in FIG. 3. When the washing machine 108 is filled with the wash or rinse waters, the floatation member 152 will float holding the substrate material 150 hanging downwardly into the wash and rinse waters thereby exposing extraneous random dye to the dye scavenging compound. Due to the turbulence created within the wash and rinse waters by the agitator 114, the entire volume of the wash and rinse waters are exposed to the dye scavenging article 148. It is contemplated that during the washing and rinse cycles, the downward force created by one rotation cycle of the agitator 114 will temporarily suck the floatation member 152 under the surface of the wash and rinse waters until the agitator reverses its rotation cycle allowing the floatation member to return to the surface of the rinse and wash waters. In other words, it is contemplated that the floatation member 152 will essentially bob up and down within the upper surface layer of the rinse and wash waters while the substrate material 150 is allowed to hang down into the rinse and wash waters. The floatation member 152 due to its buoyancy will prevent the dye scavenging article from becoming trapped within the clothing items 116 within the rinse and wash waters during the laundering process.

Figure 19:
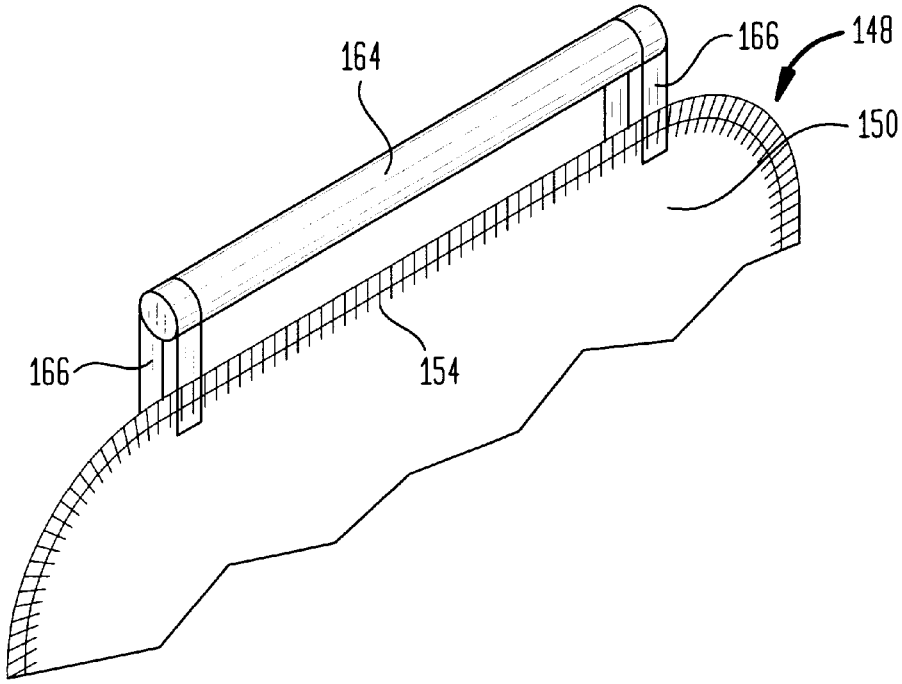
FIG. 19 is a partial perspective view of a dye scavenging article constructed in accordance with still another embodiment of the present invention.

During the laundry process, it is desirable that the substrate material 150 be maintained in a physical form which will expose the greatest surface area of the substrate material to the wash and rinse waters, and hence, to the extraneous random dyes therein. Thus, it is desirable to prevent the substrate material 150 from balling up or folding upon itself, i.e., a closed state, during the laundry process which would potentially decrease the efficiency of the dye scavenging function of the dye scavenging article 148. This can be achieved, for example, as shown in FIG. 19 by providing a stiffening member 164 attached to one edge 154 of the substrate material 150. The stiffening member 154 may be any suitable material such as a rigid polymer which will maintain the substrate material 150 in an open state. By way example, the stiffening member 164 may be constructed to have any desired shape as thus far described, see FIGS. 15–18 with respect to the floatation member 152. In addition, the stiffening member 164 can be attached to the substrate material 150 in any similar manner as described with respect to the floatation member 152, for example, the use of spaced apart straps 166, pouch 162 and the like.

The stiffening member 164 may be used in addition to the floatation member 152. Accordingly, the stiffening member 164 may be placed along one edge 154 of the substrate material 150, while a floatation member 152 may be placed along the same or another edge of the substrate material. In addition, it is specifically contemplated that the stiffening member 164 and the floatation member 152 may be a single element which provides both functions of buoyancy and preventing the substrate material 150 from collapsing into a closed state. The use of the previous materials for the floatation member 152, such as rigid, closed cell foams, closed hollow plastic tubes and the like will provide the requisite stiffness to function both as a stiffening member 164 and a floatation member 152. It is further contemplated that the floatation member 152 may be formed from non-rigid or flexible materials and optionally provided with a separate stiffening member 164. For example, a stiffening member 164 may be inserted into the pouch 162 in combination with a floatation member 152 as shown in FIG. 13.

Figure 20:
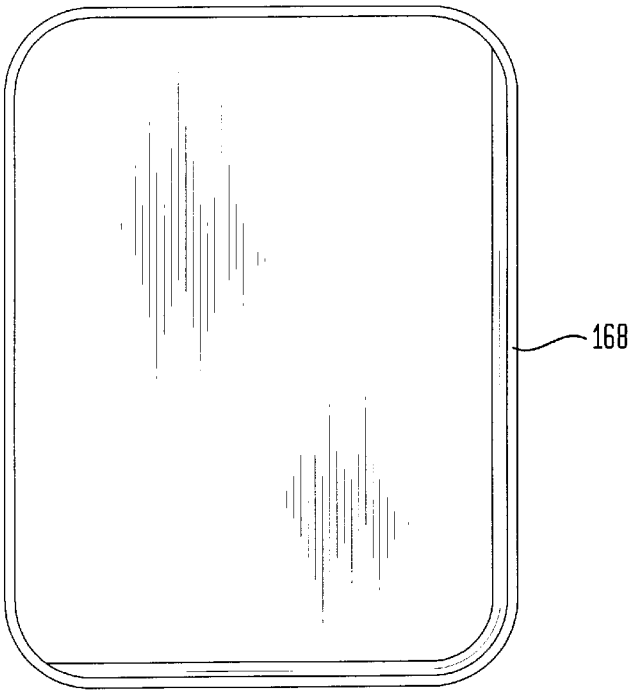
FIG. 20 is a front elevational view of a stiffening member for use in combination with a dye scavenging article constructed in accordance with still another embodiment of the present invention.
Figure 21:
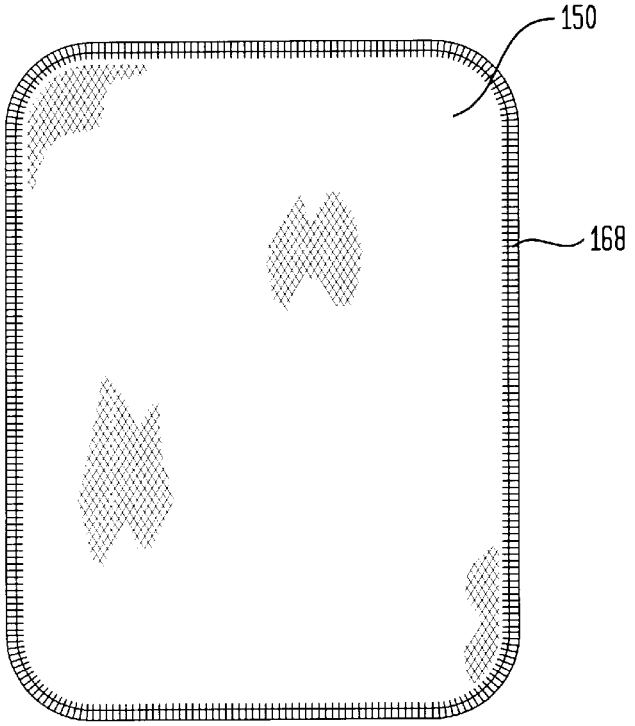
FIG. 21 is a front elevational view of a dye scavenging article incorporating a stiffening member as shown in FIG. 20.

Referring now to FIG. 20, a stiffening member 168 is constructed in the nature of a thin rectangular frame from suitably stiff plastic material so as to maintain its shape. Although the stiffening member 168 has been shown as having a rectangular shape, it is to be understood that other shapes such as triangular, oval, polygonal, circular and the like may also be used for the stiffening member. In this regard, as shown in FIG. 21, a substrate material 150 is attached to the stiffening member 168 by any number of adhering techniques. For example, the substrate material 150 may be glued, sewn, bonded or otherwise attached about its periphery to the stiffening member 168. It is contemplated that the stiffening member 168 may also be in the form of individual elongated segments which may be sewn to the edges of the substrate material 150 so as to maintain the substrate material in an open state during use.

Figure 22:
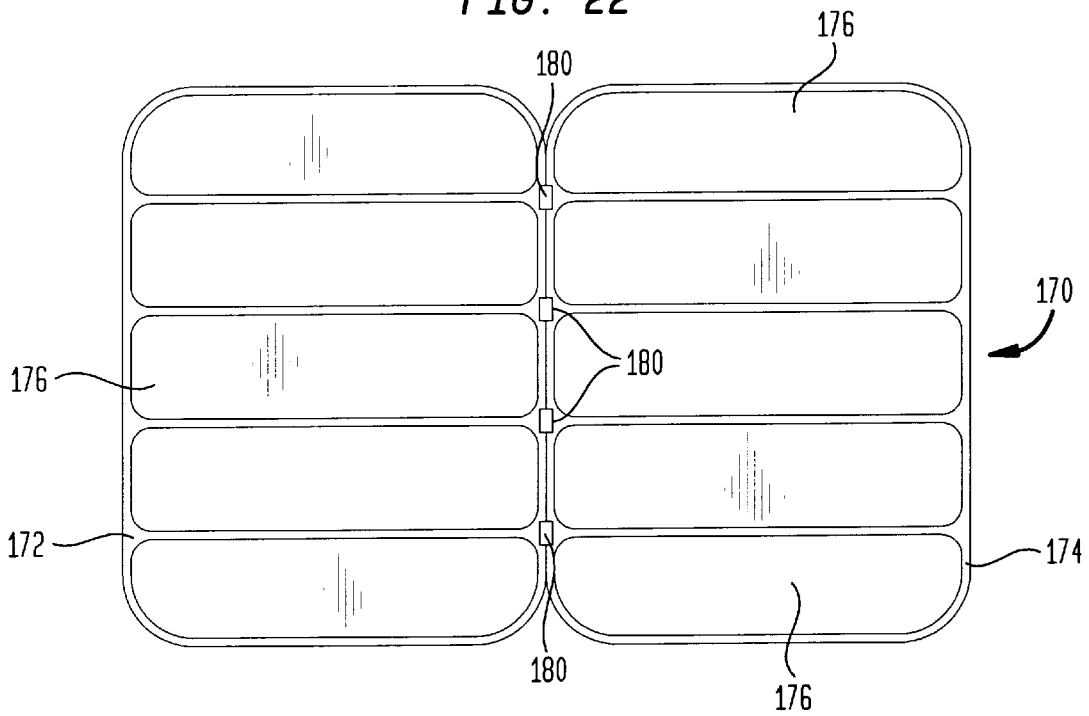
FIG. 22 is a front elevational view of a stiffening member shown in an open state constructed in accordance with still another embodiment of the present invention.
Figure 23:
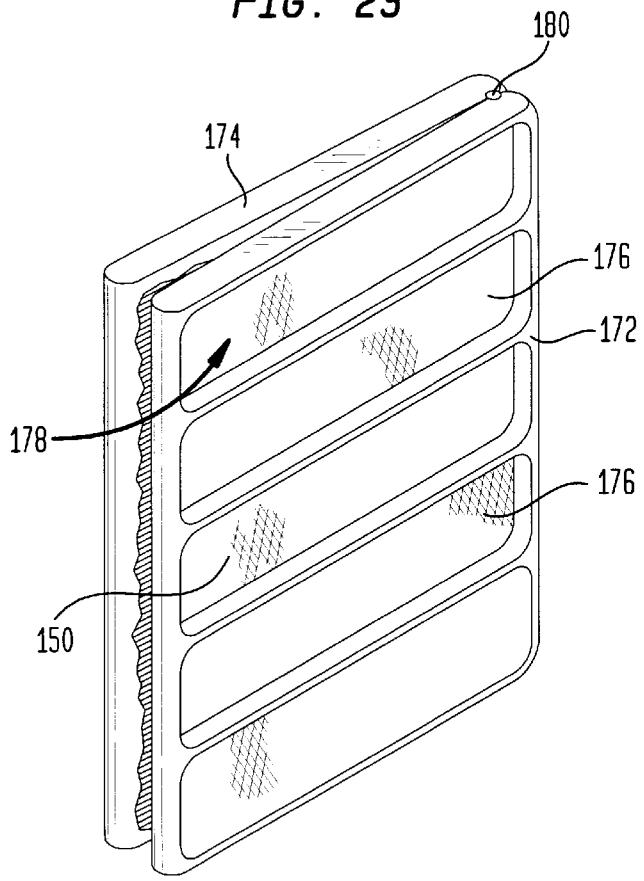
FIG. 23 is a perspective view of the stiffening member shown in FIG. 22 in a closed state.

The stiffening members 168 as thus far described are generally not reusable due to their adherence to the substrate material 150. As shown in FIG. 22, a reusable stiffening member 170 is formed from a pair of rectangular support members 172, 174 having a plurality of elongated openings 176 therein. The support members 172, 174 are attachable to each other in overlying relationship, as shown in FIG. 23, so as to define a space 178 therebetween for the receipt of the substrate material 150. The support members 172, 174 may be attached to each other by any suitable means, for example, by one or more hinges 180 attached to their peripheral edges. It is also contemplated that a living hinge formed from an integral portion between the two support members 172, 174 may also be used. Further, the support members 172, 174 may be provided as separate members and connectable to each other by any suitable means such as by a latch, clip and the like. The shape, size and location of the openings 176 may be in an infinite number of variations. Functionally, it is only required that the openings 176 create a sufficient opening to allow the wash and rinse liquids to freely flow into contact with the substrate material 150 to provide effective dye scavenging, while at the same time, maintaining the substrate material in an open state. It is further contemplated that a portion or all of the support members 172, 174 can be constructed from buoyant material to allow the stiffening member 170 to float or bob up and down in the wash and rinse liquids during the washing process.

Figure 24:
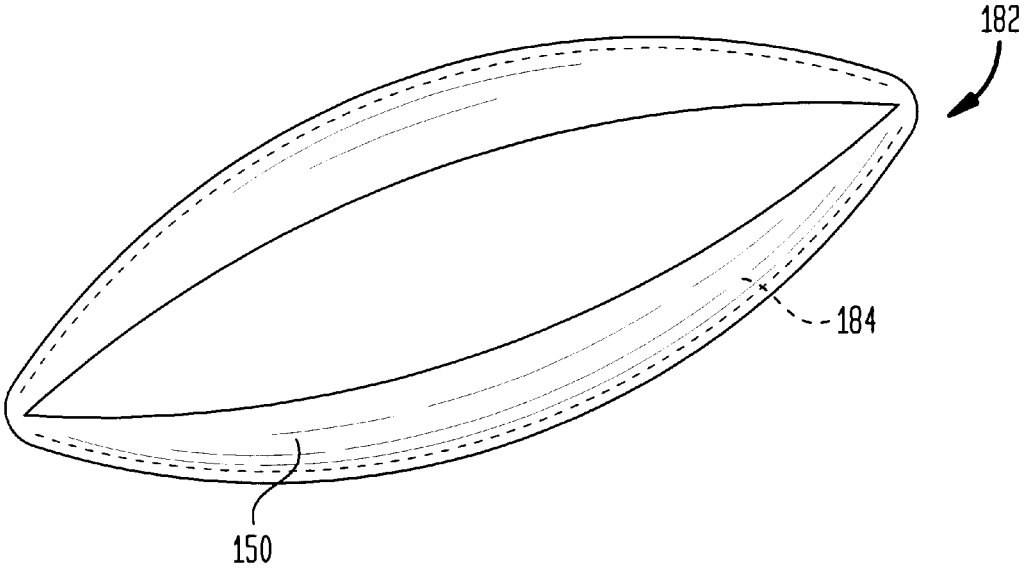
FIG. 24 is a front elevational view of a dye scavenging article constructed in accordance with still another embodiment of the present invention.
Figure 25:
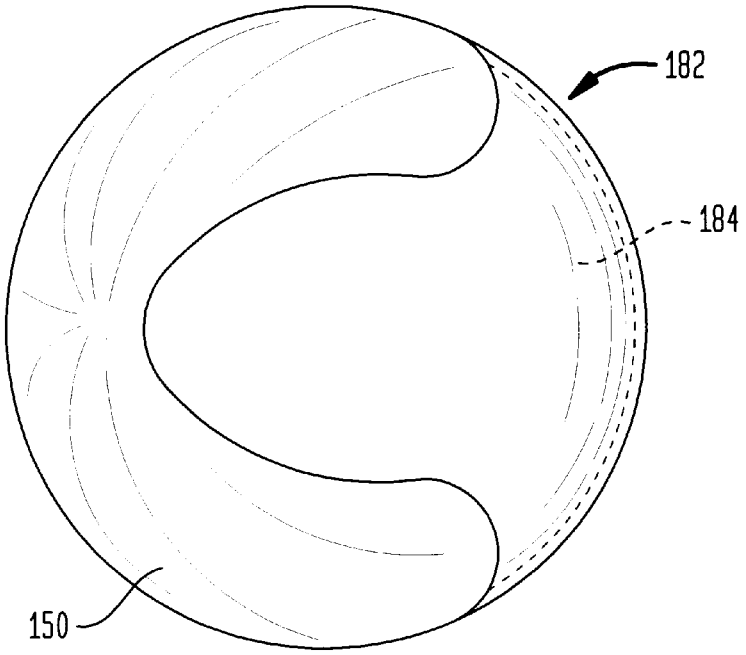
FIG. 25 is a perspective view of a dye scavenging article constructed in accordance with still another embodiment of the present invention.

Turning now to FIGS. 24 and 25, there is disclosed a further embodiment of a dye scavenging article 182 constructed in accordance with another embodiment of the present invention. The dye scavenging article is constructed from an inner body 184 of buoyant material, such as Styrofoam, cork and the like formed into a predetermined shape, for example, a football shape as shown in FIG. 24 or a spherical shape as shown in FIG. 25, as well as other shapes such as polygonal, triangular, etc. The substrate material 150 is formed so as to surround or encapsulate the body 184. The resulting dye scavenging article 182 accordingly has buoyant properties by the body 184 functioning as a floatation member, while at the same time, functioning as a stiffening member to maintain the substrate material 150 in an open state.

Although the invention herein has been described with reference to particular embodiments, it is to be understood that the embodiments are merely illustrative of the principles and application of the present invention. It is therefore to be understood that numerous modifications may be made to the embodiments and that other arrangements may be devised without departing from the spirit and scope of the present invention as defined by the claims.

What is claimed is:

1. An article for use in a washing machine operative for washing textile items in a liquid, said article comprising a substrate material supporting a dye scavenging compound, and means for increasing the buoyancy of said article whereby said substrate material is substantially prevented from becoming trapped within said items within said washing machine during the operation thereof while exposing said dye scavenging compound to said liquid.

2. The article of claim 1, wherein said substrate material comprises cellulosic material.

3. The article of claim 2, wherein said dye scavenging compound is chemically attached to said substrate material.

4. The article of claim 1, wherein the buoyancy of said means is greater than the buoyancy of said liquid.

5. The article of claim 1, wherein said substrate material is in the form of a rectangular sheet.

6. The article of claim 1, wherein said means is attached along one edge of said substrate material.

7. The article of claim 1, wherein said substrate material surrounds said means.

8. The article of claim 1, further including a stiffening member attached to said substrate material, said stiffening member maintaining said substrate material in an open state within said washing machine during the operation thereof.

9. The article of claim 1, wherein said means further maintains said substrate material in an open state within said washing machine during the operation thereof.

10. An article for use in a washing machine operative for washing textile items in a liquid, said article comprising a substrate material supporting a dye scavenging compound, and a floatation member attached to said substrate material whereby said substrate material is substantially prevented from becoming trapped within said items within said washing machine during the operation thereof while exposing said dye scavenging compound to said liquid.

11. The article of claim 10, wherein said substrate material comprises cellulosic material.

12. The article of claim 10, wherein said substrate material is in the form of a rectangular sheet.

13. The article of claim 10, wherein said floatation member is attached along one edge of said substrate material.

14. The article of claim 10, wherein said floatation member is surrounded by said substrate material.

15. The article of claim 10, further including a stiffening member attached to said substrate material, said stiffening member maintaining said substrate material in an open state within said washing machine during the operation thereof.

16. The article of claim 10, wherein said floatation member comprises an elongated member.

17. The article of claim 16, wherein said elongated member comprises a closed hollow body.

18. The article of claim 16, wherein said elongated member has a shape selected from the group consisting of round, square, oval, rectangular, triangular and polygonal.

19. The article of claim 10, further including a pouch attached to said substrate material, said floatation member received within said pouch.

20. The article of claim 19, wherein said pouch is attached along one edge of said substrate material.

21. The article of claim 10, wherein said floatation member comprises a body of Styrofoam.

22. The article of claim 10, wherein said floatation member has a buoyancy greater than the buoyancy of said substrate material.

23. The article of claim 10, wherein said floatation member further maintains said substrate material in an open state within said washing machine during the operation thereof.

24. An article for use in a washing machine operative for washing textile items in a liquid, said article comprising a substrate material supporting a dye scavenging compound, and means for maintaining said substrate material in an open state within said washing machine during the operation thereof while exposing said dye scavenging compound to said liquid, whereby said substrate material is substantially prevented from forming into a closed state within said washing machine during the operation thereof.

25. The article of claim 24, wherein said substrate material comprises cellulosic material.

26. The article of claim 24, wherein said dye scavenging compound is chemically attached to said substrate material.

27. The article of claim 24, wherein said substrate material is in the form of a rectangular sheet.

28. The article of claim 24, wherein said means is attached along one edge of said substrate material.

29. The article of claim 24, wherein said means is surrounded by said substrate material.

30. The article of claim 24, wherein said means further substantially prevents said substrate material from becoming trapped within said items within said washing machine during the operation thereof.

31. An article for use in a washing machine operative for washing textile items in a liquid, said article comprising a substrate material supporting a dye scavenging compound, and a stiffening member attached to said substrate material, said stiffening member maintaining said substrate material in an open state within said washing machine during the operation thereof while exposing said dye scavenging compound to said liquid, whereby said substrate material is substantially prevented from forming into a closed state within said washing machine during the operation thereof.

32. The article of claim 31, wherein said substrate material comprises cellulosic material.

33. The article of claim 31, wherein said dye scavenging compound is chemically attached to said substrate material.

34. The article of claim 31, wherein said substrate material is in the form of a rectangular sheet.

35. The article of claim 31, wherein said stiffening member comprises a frame, said substrate material having edges attached to said frame.

36. The article of claim 35, wherein said frame is in the shape of a rectangle.

37. The article of claim 31, wherein said stiffening member is constructed of plastic material.

38. The article of claim 31, further including a pouch attached to said substrate material, said stiffening member received within said pouch.

39. The article of claim 31, wherein said stiffening member comprises at least one elongated member attached to one edge of said substrate material.

40. The article of claim 31, wherein said stiffening member comprises a body of buoyant material covered by said substrate material.

41. The article of claim 40, wherein said body is in the shape of a sphere or an oval.

42. The article of claim 40, wherein said body is Styrofoam material.

43. The article of claim 40, wherein said body is hollow.

44. The article of claim 31, wherein said stiffening member comprises a support having a plurality of openings therein.

45. The article of claim 44, wherein said stiffening member comprises a pair of said supports joined together in overlying relationship to form a space therebetween, said substrate material received within said space.

46. The article of claim 45, wherein said pair of supports are hinged together along one edge thereof to allow access to said space for replacement of said substrate material.

47. The article of claim 31, wherein said stiffening member has a buoyancy greater than the buoyancy of said substrate material.

48. A method for controlling random dye in a liquid containing textile items during the operation of a washing machine, said method comprising the steps of placing in said liquid a dye scavenging article comprising a substrate material supporting a dye scavenging compound, attaching a buoyant member to said substrate material, said buoyant member preventing said substrate material from becoming substantially trapped within said items within said washing machine during the operation thereof, and maintaining said substrate material in substantial contact with said liquid during operation of said washing machine whereby said random dye within said liquid becomes associated with said dye scavenging compound.

49. The method of claim 48, wherein said substrate material comprises cellulosic material.

50. The method of claim 48, further including the step of chemically attaching said dye scavenging compound to said cellulosic material.

51. The method of claim 48, wherein said liquid comprises the wash and rinse waters of said washing machine.

52. The method of claim 48, wherein said buoyant member is attached along one edge of said substrate material.

53. The method of claim 48, wherein said buoyant member is surrounded by said substrate material.

54. The method of claim 48, wherein said buoyant member comprises an elongated closed hollow body.

55. The method of claim 48, wherein said buoyant member comprises a body of Styrofoam.

56. The method of claim 48, further including attaching a pouch to said substrate material, said buoyant member received within said pouch.

57. The method of claim 48, wherein said buoyant member further comprises a stiffening member.

58. The method of claim 48, wherein said buoyant member is operative for bobbing up and down in said liquid during the operation of said washing machine.

59. The method of claim 48, wherein said buoyant member has a buoyancy greater than the buoyancy of said substrate material.

60. A method for controlling random dye in a liquid containing textile items during the operation of a washing machine, said method comprising the steps of placing in said liquid a dye scavenging article comprising a substrate material supporting a dye scavenging compound, and maintaining said substrate material in a substantially open state in substantial contact with said liquid during operation of said washing machine by a rigid stiffening member whereby said random dye within said liquid becomes associated with said dye scavenging compound.

61. The method of claim 60, wherein said substrate material comprises cellulosic material.

62. The method of claim 60, further including the step of chemically attaching said dye scavenging compound to said cellulosic material.

63. The method of claim 60, wherein said liquid comprises the wash and rinse waters of said washing machine.

64. The method of claim 60, wherein said maintaining step comprises surrounding said stiffening member with said substrate material.

65. The method of claim 60, wherein said maintenance step comprises attaching said stiffening member to said substrate material.

66. The article of claim 65, wherein said stiffening member comprises a frame, said substrate material being attached about the edges thereof to said frame.

67. The article of claim 66, wherein said frame is in the shape of a rectangle.

68. The article of claim 65, wherein said stiffening member is constructed of plastic material.

69. The article of claim 60, wherein said maintaining step comprises attaching said pouch to said substrate material and inserting a stiffening member within said pouch.

* * * * *

UNITED STATES PATENT AND TRADEMARK OFFICE

CERTIFICATE OF CORRECTION

PATENT NO. : 6,035,473

DATED : March 14, 2000

INVENTOR(S) : Felstead et al.

It is certified that error appears in the above-identified patent and that said Letters Patent is hereby corrected as shown below:

Col. 2, line 49, after "effective" delete "to".

Col. 18, line 45, "said" (first occurrence) should read --a--.

Col. 18, line 46, "a" should read --said--.

Signed and Sealed this

Twenty-seventh Day of February, 2001

*Attest:*

Nicholas P. Godici

NICHOLAS P. GODICI

*Attesting Officer*

*Acting Director of the United States Patent and Trademark Office*